US007503463B1

(12) United States Patent
Stefanik et al.

(10) Patent No.: US 7,503,463 B1
(45) Date of Patent: Mar. 17, 2009

(54) ERGONOMIC PACKS FOR PRODUCTION SUPPLY

(75) Inventors: Michael L. Stefanik, Powell, OH (US); Carrie S. Simpson, Columbus, OH (US); John Detwiler, West Liberty, OH (US)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 769 days.

(21) Appl. No.: 10/963,259

(22) Filed: Oct. 12, 2004

Related U.S. Application Data

(62) Division of application No. 10/419,559, filed on Apr. 21, 2003, now Pat. No. 6,997,340.

(51) Int. Cl.
*B65D 1/24* (2006.01)
*B65D 25/10* (2006.01)
*B65D 21/02* (2006.01)

(52) U.S. Cl. ..... 220/501; 220/578; 220/23.88

(58) Field of Classification Search ..... 220/501, 220/578, 23.88, 23.6, 23.4, 523, 534, 507, 220/505; 206/501, 503
See application file for complete search history.

(56) References Cited

U.S. PATENT DOCUMENTS

| | | | | |
|---|---|---|---|---|
| 751,466 | A | 2/1904 | Colling | |
| 2,247,341 | A * | 6/1941 | Anderson | 229/120.37 |
| 3,325,001 | A | 6/1967 | Rawlings | |
| 4,171,742 | A | 10/1979 | Kohayakawa et al. | 206/449 |
| 4,444,535 | A | 4/1984 | VanMersbergen | 410/121 |
| 4,588,341 | A | 5/1986 | Motoda | |
| 4,619,365 | A | 10/1986 | Kelly et al. | 209/44.1 |
| 4,648,524 | A | 3/1987 | Ackermann | |
| 4,705,170 | A | 11/1987 | Creaden | 206/419 |
| 4,799,620 | A | 1/1989 | Velella | 229/191 |
| 4,905,834 | A | 3/1990 | Mur Gimeno et al. | 206/512 |
| 4,913,339 | A | 4/1990 | Elder | 229/120.14 |
| 4,919,277 | A | 4/1990 | Jeruzal | 211/41 |
| 4,925,038 | A | 5/1990 | Gajewski | |
| 5,277,359 | A | 1/1994 | Lindsay | 229/117.22 |
| 5,419,009 | A | 5/1995 | Assis et al. | 16/124 |
| 5,505,309 | A | 4/1996 | Taravella et al. | 206/485 |
| 5,887,782 | A | 3/1999 | Mueller | 229/183 |
| 5,921,739 | A | 7/1999 | Keip | |
| 6,007,030 | A | 12/1999 | Judge | 248/95 |
| 6,029,582 | A | 2/2000 | Ogilvie, Jr. et al. | 108/51.3 |
| 6,343,708 | B1 * | 2/2002 | Riso | 220/23.88 |
| 6,612,454 | B1 * | 9/2003 | Lin | 220/23.88 |
| 2004/0007492 | A1 * | 1/2004 | Winkler | 206/518 |

* cited by examiner

*Primary Examiner*—Anthony D Stashick
*Assistant Examiner*—Shawn M Braden
(74) *Attorney, Agent, or Firm*—Standley Law Group LLP

(57) ABSTRACT

An apparatus is disclosed for providing easier, more ergonomic access to parts stored in a shipping container to be used in a manufacturing environment. Shipping containers having trays with packaging cells for containing production parts may be accessed by a person whose responsibility it is to remove the parts from the container for use on an assembly line, for example. By enabling the trays containing packaging cells to be moved forward as parts are removed from the container, the person's job is rendered easier to access parts that would have otherwise remained at the rear of the container. In a preferred embodiment, the packaging cells or packs are arranged to slidably move closer to the person removing the parts.

21 Claims, 3 Drawing Sheets

ERGONOMIC PACKS FOR PRODUCTION SUPPLY

The present application is a division of U.S. patent application Ser. No. 10/419,559, filed on Apr. 21, 2003 now U.S. Pat. No. 6,997,340.

FIELD OF THE INVENTION

The present invention relates to an apparatus for delivering parts to an assembly line or other production area in a manufacturing environment. In particular, the present invention relates to containers and packaging cells within the containers that are designed to achieve improved ergonomics in the availability of parts for use in a manufacturing process.

BACKGROUND AND SUMMARY OF THE INVENTION

It is known to deliver parts for use in a production line to the line in containers of various types. The known containers are physically divided into layers of packaging cells, each cell for holding a part, to thereby segregate the parts from one another for ease of handling during removal from the cells and for avoidance of damage to the parts that could otherwise result from parts colliding together during movement of the shipping container. Once delivered to the production line, a person working at the production line removes individual parts from the container so that the parts may be used in the production process. For example, parts to build portions of an automobile in an automobile production line environment may arrive at the production line in a shipping container, which is placed near the production line to allow a person access to remove a part from the container for use in the production process. Some of these parts may be bulky in size, relatively heavy, and/or awkward to handle.

It is typically not economical or efficient to individually ship parts for a production process, therefore, several parts are shipped in a single container. Typically, a container may be subdivided into multiple, stacked layers with each layer having several packaging cells or "packs" wherein each pack or cell preferably contains one part to be used in the manufacturing process. The packs aid in at least two ways. First, the packs separate one part from another for ease of handling purposes. Second, the packs separate the parts from one another so that they do not become entangled with each other or collide with other parts during movement of the shipping container from one location to another.

Such known shipping containers may be several feet wide, several feet deep and several feet long, and are typically designed to fit on a standard 48 inch by 45-inch pallet base. The shipping containers may contain multiple layers stacked on top of one another with each layer having a plurality of packaging cells or packs. Once the shipping container is brought to the manufacturing environment to be used, for example, in providing parts for a production line, the container may be placed in a position next to or near the line and the person working at that area begins to remove parts from the packs in the shipping container. Due to the nature of the size of the shipping container and the number of parts in it there will be parts that exist in packs relatively closer to the person responsible for handling the parts and there will be other parts further removed, in packs at the rear of the shipping container, that will necessitate a longer reach by the person removing the parts. Therefore, certain parts contained in packs at the rear of the shipping container will be more difficult to reach and lift out of the packs in the rear of the container.

The present invention is an improved shipping container comprising multiple trays per layer within the container, each tray having packs thereon, designed with ergonomics in mind. Therefore, the present invention is relatively easier for a person handling the parts to use. The ergonomic packs of the present invention may be arranged on or form a part of a tray. As a forward resting tray within a layer of the container is emptied of parts from each pack, that tray may be removed from the container and a rearward resting tray may be grasped by its handle and the tray pulled forward in the container so that the parts in the packs of that tray may now be more easily retrieved from each pack. Each tray may be supplied with a handle for enabling a person to slide trays having packs thereon closer to the person. Parts that may be in packs at the rear of the container are thus able to be moved forward or closer to the person prior to removing those parts from the rear-most packs. By enabling the person handling the parts to lesson the moment arm (resulting from the length of the reach a person has to make to grasp a part in a rearward pack multiplied by the weight of the part) the person handling the parts requires less force and thereby the parts removal process is rendered easier.

The trays are preferably adapted to slide with respect to a surface beneath them using a differential height design for the walls of the packs. In addition to the differential wall height of the packs, the assembly of the packs is done in a manner that allows for a smooth bottom surface under the trays to enable the trays to freely slide with respect to the surface beneath them (which may be another layer or tray of additional packs in a stacked configuration within the container).

DESCRIPTION OF EXAMPLE EMBODIMENTS

Figure 1:
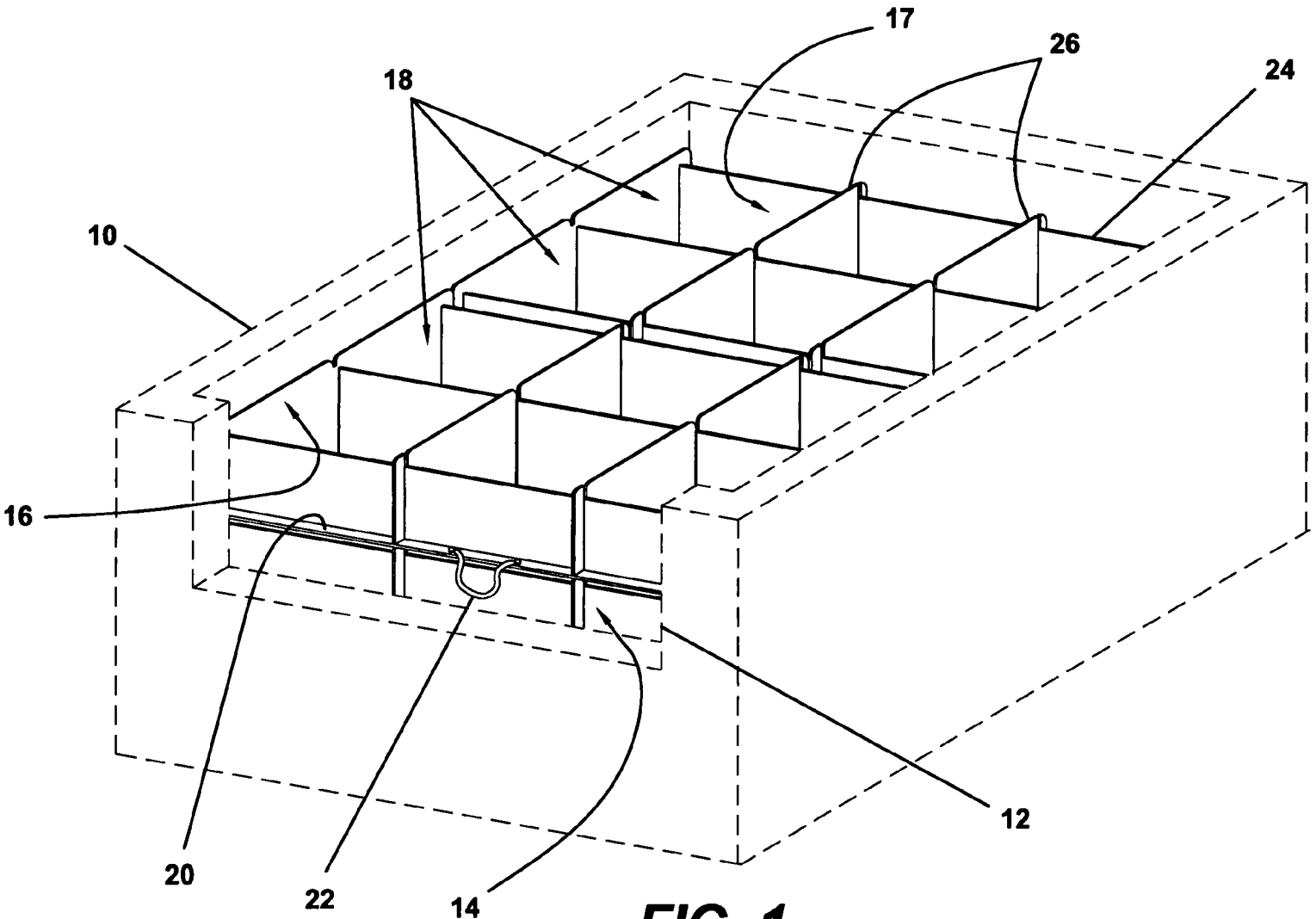
FIG. 1 is a perspective view of the ergonomic packs formed on trays of the present invention as shown in a shipping container.

Referring now to the drawings, and particularly FIG. 1, there is shown (in phantom) a parts shipping container 10, sometimes referred to as a drop shipment container or "drop shipper". Depending upon the height of the shipping container, the shipping container may or may not have a door or access panel that opens to create access to parts inside the shipping container through an opening 12. In the preferred embodiment of the invention as shown in FIG. 1, a plurality of stacked shipping trays 14, 15, 16, 17 are contained within the container 10. Within each tray 14, 15, 16, 17 there are a plurality of packaging cells or packs 18. Each pack 18 is of a sufficient length, width and depth to house a part to be used in a manufacturing process. The packs 18 may be formed with walls 24, 26 secured to a lower surface 20 of the tray.

Figure 3:
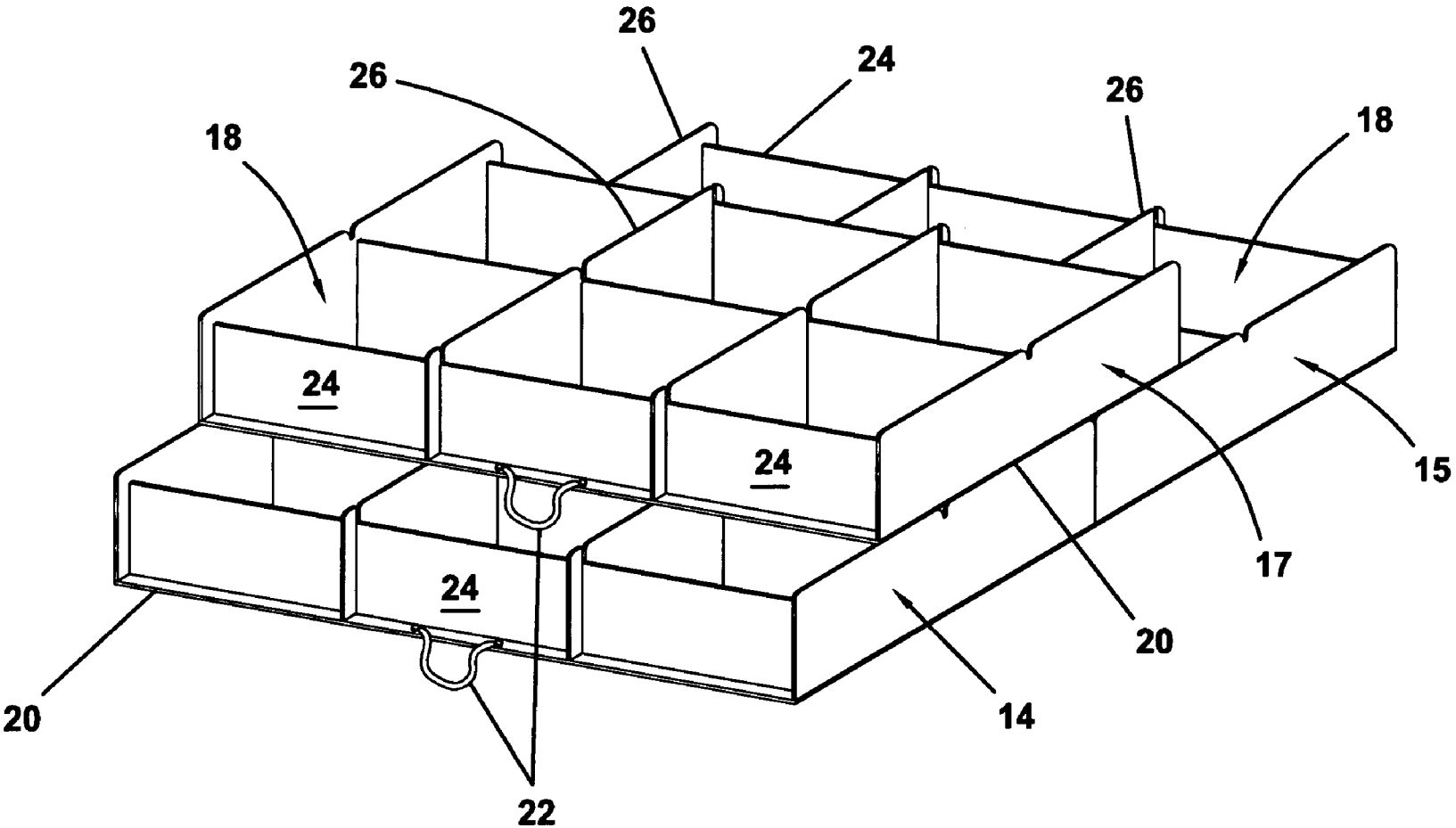
FIG. 3 is a perspective view showing three trays of packs in a stacked configuration with the upper layer tray shown in a position where it has been slid forward with respect to the lower layer trays.

Each pack 18 need not be the same size and shape as other packs on a tray. A variety of different sizes and shapes for the packs 18 may be incorporated to efficiently accommodate different sizes and shapes of parts to be used in a manufacturing process. Typically, a person removing parts from the container 10 would stand at or near the front of the container 10 and reach for the parts contained in the packs 18 nearest the front. Upon emptying the parts from the packs 18 nearest the front, the person removing the parts would have reached back to the packs 18 at the rear of the shipping container 10 to access the parts held in those packs. To make it easier for the person removing the parts, the packs 18 on the trays at the back of the container of the present invention are adapted to be moved closer to the person removing the parts. For example, as shown in FIG. 3, tray 16 (then empty) has been removed from the container and with a handle 22 that may be secured to a portion of tray 17 the person removing the parts may grasp the handle 22 and pull the tray 17 forward, closer to the front, to gain easier access to the parts held in the packs 18 in tray 17.

In order to enable upper layer trays 16 and 17 to move relative to the lower trays 14, 15, certain design features are preferably implemented to enable the sliding of upper layer trays over lower layer trays. In a preferred embodiment, the walls 24, 26 of each pack 18 are given a differential height to enable an upper layer tray to slide longitudinally toward the front over the top of tray 14 for example. As shown in FIG. 3, the longitudinal walls 26 (i.e., walls running the same direction as the direction of slide) are of an increased height relative to the lateral walls 24 (i.e., walls running perpendicular to the direction of slide). Such a construction of the walls of the packs on the trays enable the bottom surface 20 of each tray to slide unimpeded along the upper rim surfaces of the longitudinal walls 26 of lower trays. The longitudinal walls 26 may include rounded edges 27 to further facilitate sliding of the relative trays. Furthermore, the trays are preferably assembled in such a manner that the lower surface 20 has a smooth sliding surface in contact with lower trays. For example, the walls 24, 26 of the packs on tray 16 may be secured to an up side of bottom 20 using sonic welds that are done internally of each pack 18 so as to not impede the down side sliding surface of bottom 20.

Figure 2B:
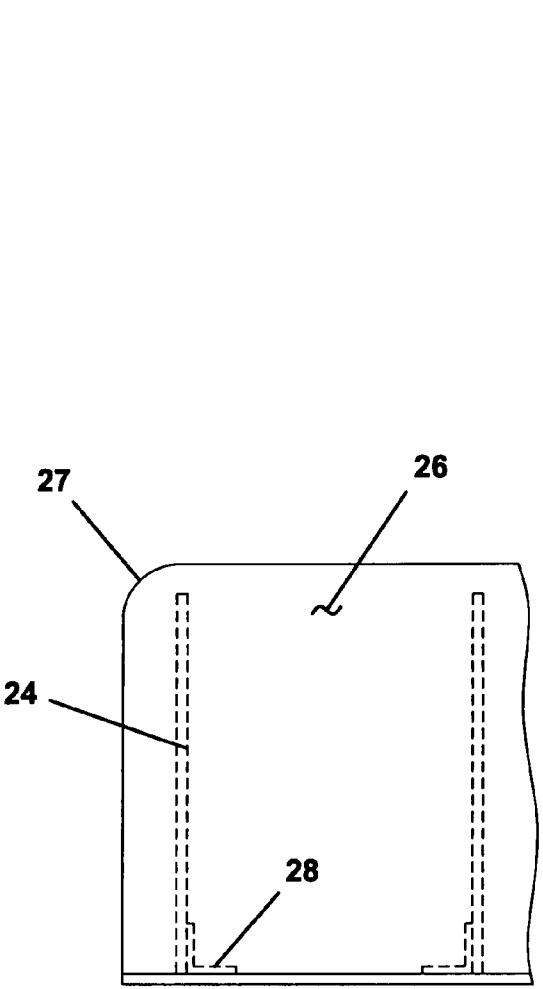
FIG. 2B is a partial side view of the tray of FIG. 2A.
Figure 2C:
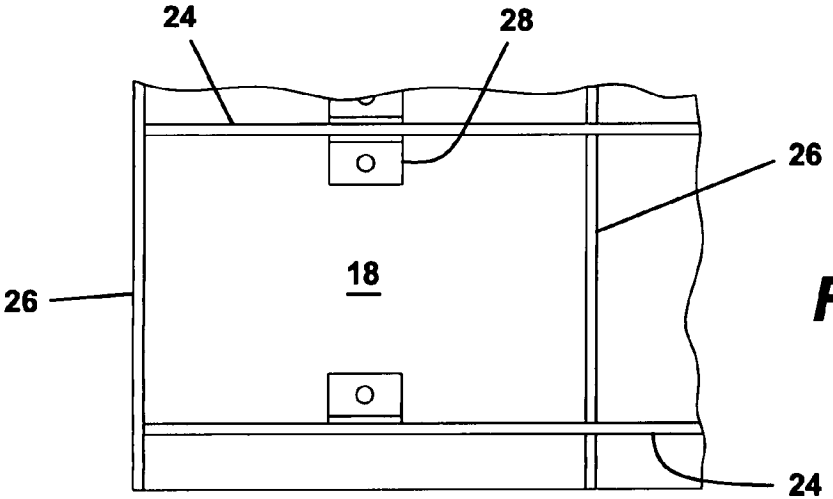
FIG. 2C is a partial plan view of the open end of the tray shown in FIG. 2A.
Figure 2A:
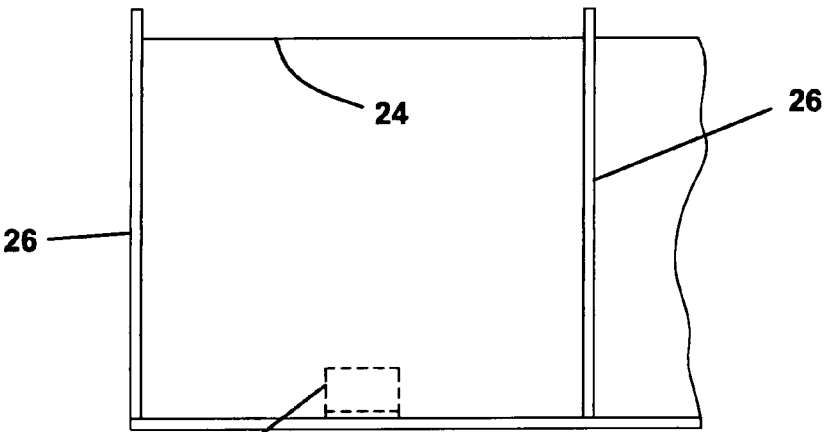
FIG. 2A is a partial end elevation view of a tray of the present invention.

This can be better seen in FIGS. 2A, 2B and 2C. The sonic welds 28 are performed inside the packs 18 rather than on the down-side surface of bottom 20 that slides on the upper rim surfaces of trays 14, 15. Once tray 17 is slid forward in the container 10 and the person handling the parts successfully removes the parts in the rear-most packs 18, the entire tray 17 may be physically removed from the container 10 enabling access to the parts contained on trays 14, 15. The same process is then repeated whereby parts in the forward most packs 18 of tray 14 are removed first, tray 14 is then lifted out of the container 10, the rearward tray 15 is pulled forward and the parts in the packs 18 of the rearward tray 15 are then retrieved. By providing the trays with means to move forward, closer to the front, the person handling the parts exerts a lower moment arm with respect to the force needed to remove a part from a rearward pack.

The present invention thus reduces the level of exertion necessary to remove parts from shipping containers in a manufacturing environment by enabling a person removing parts from such a container to pull or slide trays with packs containing parts forward in the shipping container thereby reducing the moment arm for removing parts in the rearward most tray packs. As a result, production line efficiency is improved which may result in reduced production costs.

The present invention solves ergonomic reach and weight constraints affiliated with shipment of parts of substantial weight and quantity to production lines. Parts packed in quantities may be manually handled with less effort by minimizing pack weight and drag force. By reducing the latitudinal or cross member cell wall heights relative to the longitudinal length member cell wall heights, sliding of the packaging cell trays is enabled without interference from the walls of the packs. Furthermore, the unimpeded, internal sonic welded flat sheets holding the walls of the packs to the bottom of the trays eliminates the need for external securing devices such as welds, nuts, bolts, etc. from impeding the sliding action.

Shipping containers 10 are available from numerous sources around the world and are well known to those of skill in the art. The individual packaging cell trays may be purchased from Polycell Incorporated in Columbus, Ohio.

INDUSTRIAL APPLICABILITY

The present invention improves the delivery of parts to a production line of a manufacturing facility by improving the accessibility of parts stored in packaging cells at or near the rear of shipping containers. By enabling the parts stored at the rear of the shipping containers to be more readily accessible to the person removing the parts from the shipping container, the removal of parts for production line purposes is rendered easier for the person having that responsibility.

While example embodiments of the invention have been illustrated and described, various modifications and combinations can be made without departing from the spirit and scope of the invention. For example, the trays and packs may be made of various materials, shapes, and sizes. Furthermore, the packaging trays may be constructed to move in a manner other than a simple sliding motion over a lower surface. Modifications, combinations, and equivalents to the apparatus of the present invention are intended to be covered and claimed herein.

What is claimed is:

1. A container apparatus comprising:

a shipping container for storing parts in multiple layers within said container;

a parts removal opening through at least one wall of said container for facilitating removal of parts therefrom;

a first tray associated with each layer in said container, each first tray comprising a plurality of packaging cells for containing a first collection of parts and resting nearest to said parts removal opening, each first tray to be removed from said container when empty of said first collection of parts;

a second tray associated with each layer in said container, a second tray of a given layer initially resting rearward of a first tray of the same layer with respect to said parts removal opening, each second tray comprising a plurality of packaging cells for containing a second collection of parts, each second tray further adapted to be pulled closer to said parts removal opening subsequent to removal of a first tray from the same layer and prior to removal of a second collection of parts from the respective second tray and from said container; and a plurality of upwardly extending walls associated with each tray, the walls longitudinally oriented in an intended direction of travel of said trays being taller than the walls of said trays extending in a direction substantially transverse thereto and provided to support and facilitate sliding of upper trays over lower trays toward said parts removal opening.

2. The apparatus of claim 1, wherein said packaging cells of at least each second tray are comprised of walls secured to an up-side of a bottom surface thereof so as not to impede the smooth sliding surface of the under-side of said bottom surface.

3. The apparatus of claim 2, wherein said walls are secured to said up-side of said bottom surface by sonic welds placed inside said packaging cells.

4. The apparatus of claim 1, wherein said second tray has a smooth under-side, lower bottom surface for enabling easy sliding of said second tray over a lower layer within said container.

5. The apparatus of claim 1, wherein said packaging cells of at least said first tray are comprised of walls made from corrugated plastic material.

6. The apparatus of claim 1, wherein said second tray is equipped with a handle for pulling said second tray closer to said parts removal opening prior to removing parts from said second tray.

7. A container tray for use in a container apparatus adapted to receive multiple layers of said trays, comprising:

a bottom having a plurality of upwardly extending walls forming packaging cells thereon, each packaging cell capable of containing at least one part;

a means for facilitating the pulling forward of said tray within said container apparatus; and a surface on said bottom, said surface adapted to allow for unimpeded sliding of said tray over other trays located in subjacent layers within said container apparatus;

wherein said bottom is dimensioned to allow for at least two trays to be arranged one behind the other within said container apparatus; and wherein a plurality of said upwardly extending walls that are longitudinally disposed along an intended direction of travel of each tray within said container apparatus are taller than other upwardly extending walls of each tray that extend in a direction transverse thereto, said taller walls collectively forming a substantially planar surface over which a superjacent tray may rest and slide.

8. The tray of claim 7, wherein said packaging cells are formed of walls assembled to said bottom.

9. The tray of claim 8, wherein said walls are assembled to said bottom using sonic welds internal of said cells.

10. The tray of claim 8, wherein said packaging cell walls are made of corrugated plastic material.

11. A container apparatus comprising:

a container having upwardly extending side walls attached to a bottom, and a parts removal opening through at least one side wall for facilitating removal of parts from said container;

a plurality of trays adapted to store and separate parts, said trays arranged in multiple layers within said container;

a forward tray in each layer in said container, said forward tray adapted to contain a first collection of parts, said forward tray to be removed from said container when empty of said first collection of parts; and a rearward tray in each layer in said container, said rearward tray adapted to contain a second collection of parts, said rearward tray further adapted to be pulled forward over subjacent trays and toward said parts removal opening subsequent to removal of a corresponding forward tray and prior to removal of said second collection of parts from said container;

wherein each tray includes a plurality of upwardly extending walls that are oriented along both an intended direction of travel of each tray within said container apparatus and along a direction substantially transverse thereto, said plurality of upwardly extending walls oriented along said intended direction of travel of each tray being taller than said substantially transversely oriented upwardly extending walls, said taller walls collectively forming a substantially planar surface over which a superjacent tray may rest and slide.

12. The container apparatus of claim 11, wherein each tray comprises a bottom having a plurality of upwardly extending walls attached thereto.

13. The apparatus of claim 12, wherein said walls form a plurality of individual packaging cells.

14. The apparatus of claim 12, wherein said walls are secured to a top side of said bottom so as not to impede the smooth sliding surface of the underside thereof.

15. The apparatus of claim 13, wherein said walls are secured to said top side of said bottom by sonic welds.

16. The apparatus of claim 12, wherein said walls are made from corrugated plastic material.

17. The apparatus of claim 11, wherein at least said rearward tray is equipped with a handle for pulling said rearward tray forward prior to removing parts from said rearward tray.

18. The apparatus of claim 11, wherein said forward tray is also adapted to be pulled forward, thereby allowing said forward tray to be used as a rearward tray.

19. The apparatus of claim 18, wherein said forward tray is equipped with a handle.

20. The apparatus of claim 1, wherein said first tray is also adapted to be pulled forward, thereby allowing said first tray to be substituted for said second tray.

21. The apparatus of claim 20, wherein said first tray is equipped with a handle.

* * * * *

UNITED STATES PATENT AND TRADEMARK OFFICE

CERTIFICATE OF CORRECTION

PATENT NO. : 7,503,463 B1
APPLICATION NO. : 10/963259
DATED : March 17, 2009
INVENTOR(S) : Stefanik et al.

It is certified that error appears in the above-identified patent and that said Letters Patent is hereby corrected as shown below:

In column 6, lines 30-31, please delete "15. The apparatus of claim 13, wherein said walls are secured to said top side of said bottom by sonic welds." and insert -- 15. The apparatus of claim 14, wherein said walls are secured to said top side of said bottom by sonic welds. --

Signed and Sealed this

Twenty-first Day of April, 2009

John Doll

JOHN DOLL
*Acting Director of the United States Patent and Trademark Office*